United States Patent [19]

Thompson

[11] Patent Number: 5,014,955

[45] Date of Patent: May 14, 1991

[54] SURFBOARD HOLDER

[76] Inventor: Victor R. Thompson, P.O. Box 10007, Wilmington, N.C. 28405

[21] Appl. No.: 561,955

[22] Filed: Aug. 2, 1990

[51] Int. Cl.[5] ..... A47F 7/00

[52] U.S. Cl. ..... 248/309.1; 248/316.1; 206/583; 441/74; 211/89

[58] Field of Search ..... 248/610, 201, 309.1, 248/313, 316.1, 316.6, 317, 323; 211/87, 89, 60.1; 441/74; 114/39.2; 206/583, 334; 224/257

[56] References Cited

U.S. PATENT DOCUMENTS

| | | | |
|---|---|---|---|
| 1,061,669 | 5/1913 | Hawk | 248/610 |
| 1,847,992 | 3/1932 | Upper | 248/610 |
| 2,899,154 | 8/1959 | Zavolner | 248/316.1 |
| 3,346,228 | 10/1967 | Thorman | 211/89 |
| 4,016,976 | 4/1977 | Cosper | 248/583 |
| 4,796,762 | 1/1989 | Law | 211/89 |
| 4,878,585 | 11/1989 | Orestano | 248/309.1 |
| 4,903,875 | 2/1990 | Smart | 224/257 |

OTHER PUBLICATIONS

*Surfer* magazine, Jul. 1989, p. 166.
*Surfer magazine, Sep. 1989, p. 185.*
*Surfing* magazine, Oct. 1989, p. 129.

*Primary Examiner*—Ramon O. Ramirez
*Assistant Examiner*—Robert A. Olson
*Attorney, Agent, or Firm*—Olive & Olive

[57] ABSTRACT

The surfboard holder of the invention comprises a first piece having an enclosure for insertion of a first end of a surfboard; a second piece having an enclosure for insertion of a second end of a surfboard; and a stretchable cord member extending from the first piece to the second piece. One of the two pieces is attachable to a wall or other surface.

6 Claims, 2 Drawing Sheets

SURFBOARD HOLDER

BACKGROUND OF THE INVENTION

1. Field of the Invention

This invention relates to surfboards and more particularly pertains to means for holding a surfboard suspended on a wall for storage purposes while the surfboard is not in use.

2.Description of the Related Art

Surfboards are difficult to store when they are not being used because of their length, which is generally about six feet or more, and because of their bulky irregular shape. The presence of one or more keel structures on each surfboard makes it difficult if not impossible to stack them, and their sleek, oval shape is not conducive to gripping the surfboards to hang them on a vertical surface. Often the only solution is to lean the surfboard against the wall or on the floor.

A number of different devices have been designed to hold surfboards to a vertical surface when the surfboards are not in use. One example of a surfboard holder, called STOWAWAY TM (Progressive Sport Products, Solana Beach, Calif.), consists of a linear strip having perpendicularly attached to it at each end a two-ended endstrip, with each endstrip being fastenable into a loop. One end of the surfboard is placed within one loop, and then while holding the surfboard in place, the second endstrip is fastened around the surfboard.

Another surfboard holder, the CALIFORNIA SLING TM (California Sling, San Diego, Calif.), has a first linear strip with a loop at one end and two end strips at the second end. The pointed end of the surfboard is placed in the loop after the holder is mounted on a surface, and then, while the surfboard is held with one hand, the other hand places the end strips around the rounded end of the surfboard and attaches the end strips together.

Surfboards may also be attached to surfaces with individual slings encircling each end of the surfboard, with the slings being separately attached to the surface so that the surfboard hangs horizontally extending between the two slings.

Each of these previous surfboard holders requires placement of one end of the surfboard in an encircling enclosure which is usually an arrangement of straps, followed by careful holding of the surfboard while it is balanced in the first enclosure, grasping the ends another set of straps, pulling these straps around the surfboard and attaching them together with VELCRO TM or other means to hold the other end of the surfboard in place. Thus, it is time-consuming and somewhat tricky to use the prior holders. These prior holders in some cases are not very sturdy and may not hold the surfboard securely to the wall. The prior holders also may not be very adjustable for surfboards of varying lengths or widths.

It is therefore an object of this invention to provide a surfboard holder into which a surfboard of any of a number of widths and lengths may easily be placed.

It is a further object of this invention to provide a surfboard holder which holds a surfboard securely and is sturdy.

It is a further object of this invention to provide a surfboard holder which is inexpensive and easy to manufacture.

It is a further object of this invention to provide a surfboard holder which does not require a multitude of straps and VELCRO TM or other fasteners to hold the surfboard in place.

Other objects and advantages will be more fully apparent from the following disclosure and appended claims.

SUMMARY OF THE INVENTION

The surfboard holder of the invention comprises a first piece having an enclosure for insertion of a first end of a surfboard; a second piece having an enclosure for insertion of a second end of a surfboard; and a stretchable cord member having two sections, each of said sections extending from the first piece to the second piece. The piece that is placed at the top end of the hung surfboard is attachable to a vertical surface such as a wall.

Preferably the first piece is generally triangular for placement of the pointed end of a surfboard, and has an insertion tunnel for the cord. The preferred second piece has a hole in each side so that one end of the cord may be inserted through each hole an knotted. This keeps the cord from pulling out when weight is placed on the first piece.

When the upper piece is mounted on a vertical surface, a surfboard having a pointed end, a rounded end and a keel structure may be placed on the holder using the following steps: orienting the surfboard with the pointed end downward and the keel structure away from the wall; inserting the pointed end of the surfboard in the lower, preferably triangular enclosure; stretching the cord member and pulling the first piece downward by pulling down on the surfboard; and inserting the rounded end of the surfboard in the enclosure on the second piece.

Other aspects and features of the invention will be more fully apparent from the following disclosure and appended claims.

DETAILED DESCRIPTION OF THE INVENTION AND PREFERRED EMBODIMENTS THEREOF

Figure 1:
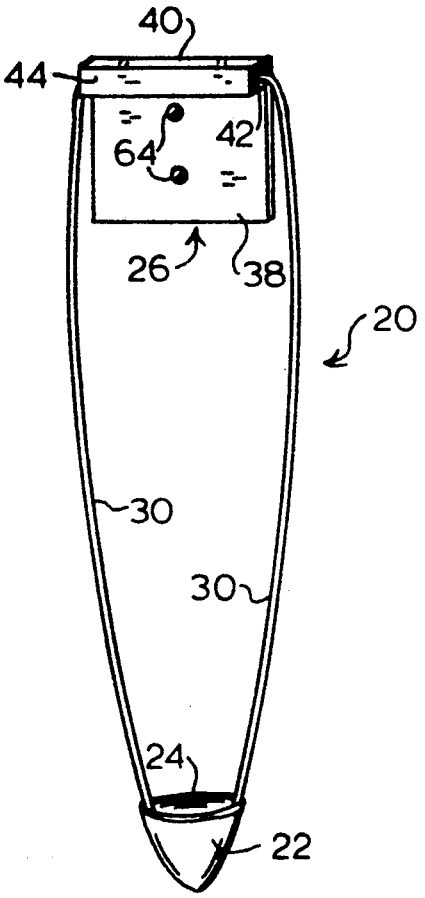
FIG. 1 is a perspective view of the surfboard holder of the invention as it appears when mounted on a surface prior to use.
Figure 2:
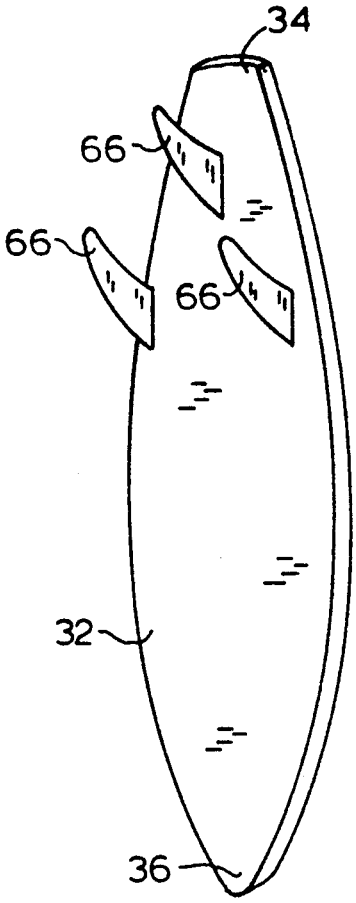
FIG. 2 is a perspective view of the bottom side of a surfboard which may be placed in the surfboard holder of the invention.

The surfboard holder 20 of the present invention comprises a first, or lower, piece 22 having an enclosure 24, a second, or upper, piece 26 having an enclosure 28, and a cord member 30 extending between the two pieces (FIG. 1). The first and second pieces have a shape and design to hold a surfboard 32 by insertion of the ends of the surfboard in the enclosures (FIG. 2). The rear or stern end 34 is generally more rounded than the generally pointed bow or front end 36. For simplicity the two ends are referred to herein as the rounded end 34 and the pointed end 36, respectively.

Although it is preferred that the enclosures of both the first and second pieces are closed except for the side from which the surfboard ends are inserted, one or both of the pieces may be designed with one or more openings each for ventilation or design purposes (not shown).

The upper piece 26 in its preferred embodiment comprises a flat back surface 38, an upper panel 40, two side panels 42 and a front panel 44 which together form a box which is open at the bottom. Preferably, the size of the opening of the enclosure 28 is sufficient to insert the rounded end 34 of the surfboard 32 with a front overhang formed by the front pane 44 sufficient to hold the inserted surfboard end in the enclosure 28. As a non-limiting example, the pieces of the upper piece 26 may form an enclosure 28 which is about 23–26 cm wide, about 3–4 cm deep, and about 4–5 cm high for holding a standard surfboard 32. Preferably the back surface 38 extends down below the enclosure 28 for about 10 or more cm, and preferably about 15 cm, to provide a surface for attachment to the wall and to provide additional supporting area to bear the weight of a surfboard placed in the holder 20. Although shown as generally rectangular in form, the back surface 38 and the upper enclosure 28 may be of any form, for example, rounded, so long as the upper end rounded end 34 of the surfboard 32 may be firmly held within the upper enclosure 28.

The upper piece 26 is formed of a sturdy, preferably lightweight substance such as plexiglas, fiberglass, plastic, wood, metal or lexan in which holes 46 may be drilled or formed. Synthetic materials are preferred because of their durability and lightness. The entire upper piece 26 may be molded in one piece, or the various sides may be made separately and attached together by glue or by other means known in the art.

Figure 3:
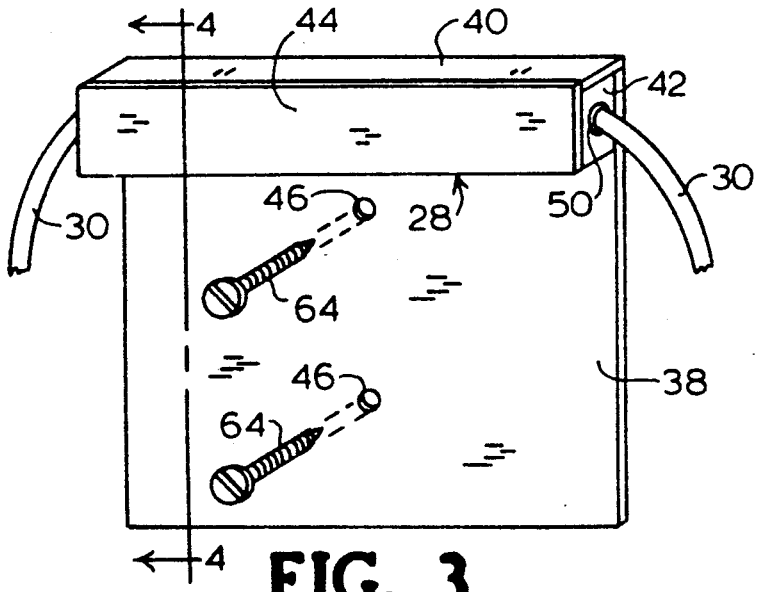
FIG. 3 is a perspective view of the upper enclosure of the surfboard holder of the invention.

Holes 46 may be placed, by drilling, molding or other means known in the art, on the back surface 38 of the upper enclosure 28 to allow it to be hung on a surface 48, such as a wall. The upper piece 26 also preferably has a hole 50 through each side panel 42 for attachment of the cord ends 52, which may be knotted on one side, such as the inside, of the enclosure or otherwise configured so that the cord 30 does not come off of the upper enclosure 26 (FIG. 3).

Figure 4:
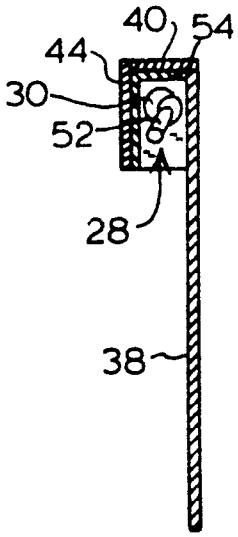
FIG. 4 is a cross-sectional view of the upper enclosure.

To keep the surfboard 32 from being scratched or dented as it is inserted into the enclosure in the upper piece 26, padding 54 is preferably placed on the inside of the upper panel 40 of the enclosure 28 and on the inside of the front panel 44 of the enclosure 26 (FIG. 4). Additional padding may be placed on other inside surfaces of the enclosure as desired. The padding may be made of any protective, soft material, for example, neoprene, felt, or rubber.

The cord member of the surfboard holder 20 is preferably a single cord 30 which is attached at each end 52 to the upper piece 26 and extends through the lower piece 22 as described below. The cord 30 may be about 250–285 cm long (preferably about 273–275), or longer as discussed below. The cord 30 is a stretchable, elastomeric cord, such as is known informally as "bunje cord" or a shock cord, generally made of synthetic materials such as polypropylene. Because the cord 30 is stretchable, the length of cord 30 on the surfboard holder 20 of preferably about 270 cm between knots, allows the cord 30 to be stretched to fit surfboards 32 having a length in the range of about 5 feet to about 8 feet. Other types of cord may have different stretch characteristics and require different lengths of unstretched cord to work best in the invention. As an alternative to one cord, the cord member may comprise two pieces of cord, extending down from opposite sides of the upper piece 26 to the lower piece 22.

If it is anticipated by the manufacturer of the surfboard holder 20 that there will be great variety of lengths of surfboards that different customers may wish to hang with the surfboard holder 20, including surfboards significantly longer than 7 feet, for which the holder is to be marketed, the manufacturer may provide a very long cord member with the surfboard holder 20, which the purchaser may choose to use in the length provided for very long boards or to shorten for surfboards of standard lengths. Shortening is done simply by cutting off one or both ends 52 of the cord 30, reinserting the cut end(s) 52 in the hole(s) 50 in the side panel(s) 42, and reknotting or reconfiguring the end)s) 52 to hold the cord 30 in the upper enclosure 28. The lower piece 22 is then recentered along the cord 30 (see below for discussion of the lower piece 22) so that the length of cord 30 on each side of it is of approximately equal length. If there are two cords or the cord is firmly attached to the lower piece 22, each end 52 needs to be cut the same amount to shorten them both.

Figure 5:
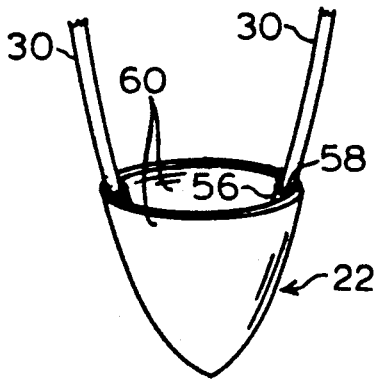
FIG. 5 is a perspective view of the lower piece of the surfboard holder of the invention.

The lower piece 22 (FIGS. 5–6) is preferably made of a soft, flexible substance such as neoprene or plastic. In the preferred embodiment, it is important that the lower piece 22 be of a size and shape to accommodate the pointed end 36 of a surfboard 32, to provide padding between the surfboard end and the wall or other surface to which the surfboard holder is attached, and to provide a means of holding the cord 30 to the lower piece 22. Where the cord 30 is all in one piece, the means of cord attachment preferably allows the cord 30 to slide through the lower piece 22. In the preferred embodiment, the lower piece 22 is formed into a generally triangular nose cone to accommodate the pointed end 36 of a surfboard 32. The triangular lower piece 22 may for example have a height of about 9–11 cm and a width across the top edge of about 14–16 cm. A deeper triangle, which therefore is wider at the top, or a somewhat smaller triangle may also be used, so long as the pointed end 36 of the surfboard fits within it and is held securely and is not too difficult to insert.

In one preferred embodiment the lower piece 22 is made of a sewable elastomeric, fabric-like, water-tolerant substance such as neoprene as used in diving garb. The lower piece 22 may also be made of sturdy, non-flexible material so long as it has a soft padded interior and preferably has a soft pad on the outside toward the mounting surface to minimize denting or scratches on walls, or other surfaces.

Figure 6:
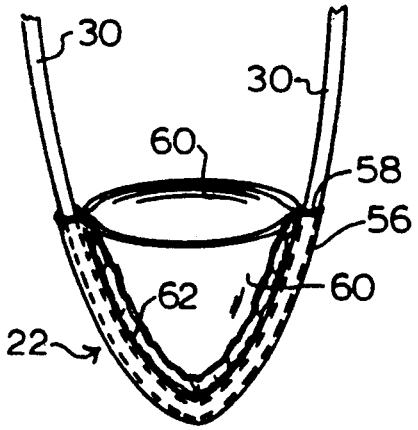
FIG. 6 is a perspective view of the lower piece of FIG. 5 turned inside out.

The lower piece 22 in the preferred embodiment is made by orienting the pieces of fabric or other substance as shown in FIG. 6. A cord-carrying looped piece 56 of sturdy material, such as canvas or other fabric, is sewn together with sturdy thread to form a tunnel 58 and is sewn to the triangular portions 60 of the lower piece 22 along stitching line 62 with durable, sturdy stitching. This material used for the looped piece 56 should be capable of withstanding the wear and tear of the inserted cord 30 being moved and stretched within it. The stitching may be done around the inserted cord 30, or the cord 30 may be inserted into the hollow tunnel 58 formed by the looped piece 56 after it is stitched. Preferably, the cord 30 is slidable within the tunnel 58 to allow for flexibility in use of the surfboard holder 20.

The surfboard holder 20 is used by placing screws 64 or nails through holes 46 in the back panel 38 of the upper piece 26 and attaching it to the surface to which the surfboard holder 20 is to be attached. Care is taken to place the upper piece 26 at a level to allow the lower end of the surfboard 32 to be above the floor level when it is hung in the surfboard holder 20. When no surfboard 32 is being held in the surfboard holder 20, the cord 30 and lower piece 22 hang below the upper piece 26 with the cord 30 being generally unstretched.

Figure 7:
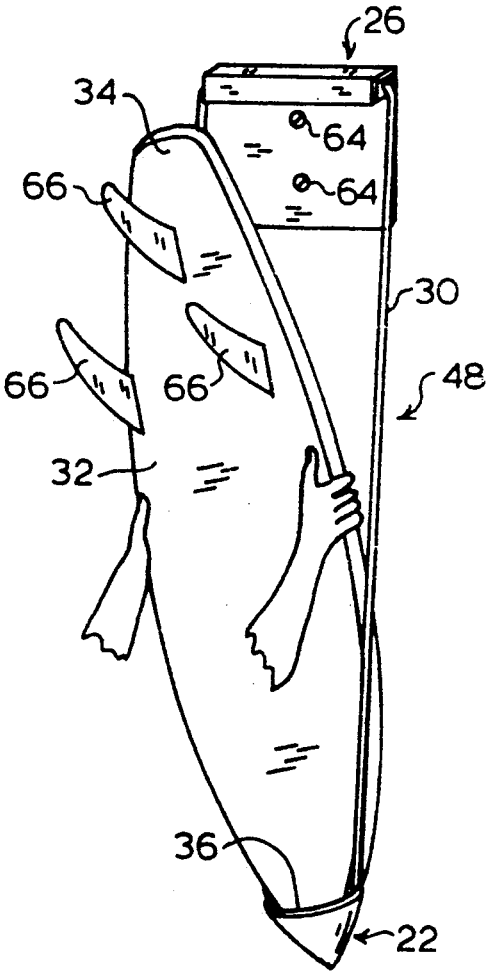
FIG. 7 is a perspective view of a surfboard being placed in the lower piece of the invention.
Figure 8:
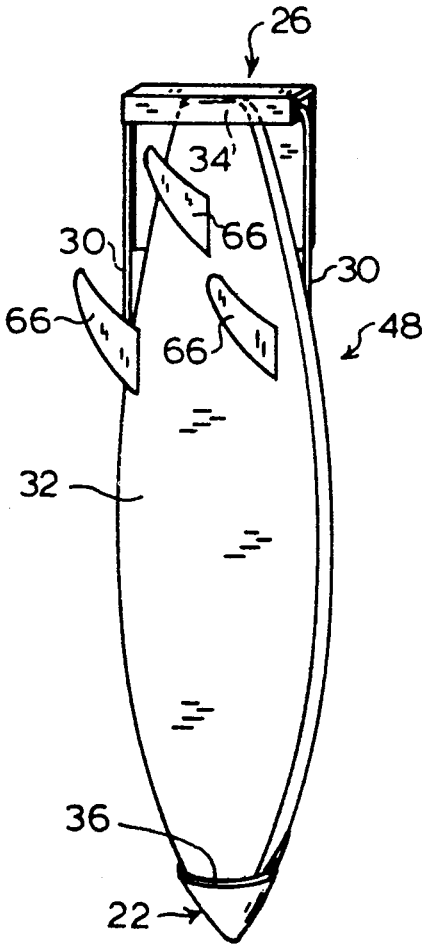
FIG. 8 is a perspective view of a surfboard placed in the surfboard holder of the invention.

Prior to placing the surfboard 32 in the holder 20 or shortly after inserting one end in the lower piece 22, care should be taken to be sure the lower piece 22 is generally centered on the cord 30 so the surfboard 32 will hang evenly when mounted in the surfboard holder 20. To put the surfboard 32 in the surfboard holder 20, the surfboard 32 is oriented with the keel members 66 away from the wall. First, the pointed end 36 of the surfboard 32 is placed in the enclosure 24 on the lower piece 22 (FIG. 7). Preferably, the surfboard 32 is placed in the lower piece 22 so that it lies between the side of the lower piece 22 that is away from the wall 48 and the central area of stitching 62 of the lower piece 22. This means that the side of the lower piece 22 which faces the wall 48 and the stitching area 62 and inserted cord 30 are between the surfboard 32 and the wall 48 to provide additional cushion between the surfboard 32 and the wall 48.

After insertion of the lower end of the surfboard 32 in the lower piece 22, the surfboard 32 is pulled down and/or out from the wall 48 so that the two sides of the cord extending up to the upper piece 26 are stretched as the lower piece 22 fitted over the bottom end of the surfboard 32 is pulled down (FIG. 7), until the rounded upper end 34 of the surfboard 32 may be slipped beneath the front panel 44 and into the upper enclosure 28 against the padded pieces 54. When the surfboard 32 is allowed to hang in the surfboard holder 20, the tension of the cord 30 pulled between the upper piece 26 and the lower piece 22 on each side of the surfboard 32 holds the surfboard 32 tightly against the padding 54 inside of the upper enclosure 28. The surfboard 32 hangs generally vertically below the upper enclosure 26.

Although the invention has been described in its preferred embodiment with the pointed end 36 of the surfboard 32 being placed downward in a generally triangular-shaped enclosure 24 of the lower piece 22 and the rounded end 34 pointing upward in the wider enclosure 28 of the upper piece 26, if it is particularly desirable for some reason to reverse the orientation of the surfboard 32 on the wall 48, the lower piece 22 may be gently rounded and the upper enclosure 26 may be formed as a downward aiming generally triangular enclosure. This embodiment is not preferred, however, because a lower rounded piece does not provide as secure and tight an enclosure for the rounded end of the surfboard as the preferred generally triangular lower piece does for the pointed end of the surfboard.

It is clear that objects other than surfboards of a shape generally similar to that of a surfboard, which are to be hung on a wall, may be hung using modifications of the preferred embodiments of the invention.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A surfboard holder, comprising:

(a) a first piece having an enclosure for insertion of a first end of a surfboard;

(b) a second piece having an enclosure for insertion of a second end of a surfboard, said second piece being mountable on a vertical surface; and (c) a stretchable cord member having two sections, each of said sections extending from the sides of the first piece to the second piece, wherein when said second piece is mounted on a vertical surface, a surfboard may be hung on the surface between the first piece and the second piece with said first end of said surfboard being enclosed by the first piece and said second end of said surfboard being enclosed by said second piece, wherein the cord member is sufficiently stretchable so that the surfboard may be placed in or removed from the holder by pulling down on the first piece away from the second piece to stretch the cord member, and increasing the distance between the first piece and the second piece so that the second end of the surfboard may be placed in or removed from the mounted second piece when the first end is in the first piece.

2. A surfboard holder according to claim 1, wherein the first piece is generally triangular for placement of the pointed end of a surfboard.

3. A surfboard holder according to claim 1, wherein each of the enclosures in the first and second pieces is closed on all sides except for the side where the end of the surfboard is inserted.

4. A surfboard holder comprising:

(a) a first piece having an enclosure for insertion of a first end of a surfboard;

(b) a second piece having an enclosure for insertion of a second end of a surfboard, said second piece being mountable on a vertical surface; and (c) a stretchable cord member having two sections, each of said sections extending from the first piece to the second piece wherein when said second piece is mounted on a vertical surface, a surfboard may be hung on the surface between the first piece and the second piece, wherein the first piece has an insertion tunnel, the second piece has a hole at each side of the enclosure, the cord is a one piece cord which extends through the tunnel, and each end of the cord is inserted through one of the holes in the second piece so that the ends of the cord do not pull out of the second piece when weight is placed on the first piece.

5. A surfboard holder, comprising:

(a) a first piece having an enclosure for insertion of a first end of a surfboard;

(b) a second piece having an enclosure for insertion of a second end of a surfboard, said second piece being mountable on a vertical surface; and (c) a stretchable cord member having two sections, each of said sections extending from the first piece to the second piece wherein when said second piece is mounted on a vertical surface, a surfboard may be hung on the surface between the first piece and the second piece, wherein the first piece is generally triangular and has a cord holding means, the second piece has a generally rectangular enclosure with padding in the enclosure and holes at the sides of the enclosure, and the cord member has ends which are placed through the holes in the second piece and knotted between the hole and the end of the cord to keep the cord ends from becoming detached from the second piece.

6. A surfboard holder which does not comprise straps or fastening means, comprising:

(a) a first piece having a triangular enclosure for insertion of a pointed end of a surfboard;

(b) a second piece having an enclosure for insertion of a rounded end of a surfboard, said second piece being mountable on a wall; and (c) a stretchable cord member extending from the second piece to the first piece and back to the second piece, wherein the cord member is sufficiently stretchable that when said second piece is mounted on a vertical surface, a surfboard having a pointed end, a rounded end and a keel structure may be placed on the holder using the following steps:

(i) orienting the surfboard with the pointed end downward and the keep structure away from the wall;

(ii) inserting the pointed end of the surfboard in the triangular enclosure;

(iii) stretching the cord member and pulling the first piece downward by pulling down on the surfboard; and (iv) inserting the rounded end of the surfboard in the enclosure on the second piece.

* * * * *

UNITED STATES PATENT AND TRADEMARK OFFICE

CERTIFICATE OF CORRECTION

PATENT NO. : 5,014,955

DATED : May 14, 1991

INVENTOR(S) : Victor R. Thompson

It is certified that error appears in the above-identified patent and that said Letters Patent is hereby corrected as shown below.

Column 2, line 21, delete "an" and replace with --and--.

Column 3, line 18, delete "pane" and replace with --panel--.

Claim 6 at column 8, line 10, delete "keep" and replace with --keel--.

Signed and Sealed this

Eighth Day of September, 1992

*Attest:*

DOUGLAS B. COMER

*Attesting Officer*

*Acting Commissioner of Patents and Trademarks*